US011473848B2

(12) United States Patent
Chen et al.

(10) Patent No.: US 11,473,848 B2
(45) Date of Patent: Oct. 18, 2022

(54) THERMOSIPHON HEAT EXCHANGER

(71) Applicant: DELTA ELECTRONICS, INC., Taoyuan (TW)

(72) Inventors: Chia-Wei Chen, Taoyuan (TW); Wei-Zhi Huang, Taoyuan (TW); Kun-Chieh Liao, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 169 days.

(21) Appl. No.: 17/081,572

(22) Filed: Oct. 27, 2020

(65) Prior Publication Data

US 2021/0041180 A1 Feb. 11, 2021

Related U.S. Application Data

(63) Continuation-in-part of application No. 16/881,847, filed on May 22, 2020, now Pat. No. 11,333,444, which is a continuation of application No. 14/292,427, filed on May 30, 2014, now Pat. No. 10,697,709.

(30) Foreign Application Priority Data

Oct. 31, 2013 (CN) ..... 201310536088.4
Jun. 9, 2020 (CN) ..... 202021062179.0

(51) Int. Cl.

| | |
|---|---|
| ***F25D 23/12*** | (2006.01) |
| ***F28D 15/02*** | (2006.01) |
| ***F28F 13/06*** | (2006.01) |
| ***F28F 19/00*** | (2006.01) |

(52) U.S. Cl.
CPC ..... *F28D 15/0266* (2013.01); *F28F 13/06* (2013.01); *F28F 19/00* (2013.01); *F28D 2015/0216* (2013.01)

(58) Field of Classification Search
CPC .. F28D 15/0266; F28D 15/02; F28D 15/0275; F28D 2015/0216; F28D 1/024; F28F 13/06; F28F 19/00; H01L 23/427
USPC ..... 62/259.2
See application file for complete search history.

(56) References Cited

U.S. PATENT DOCUMENTS

| | | | | |
|---|---|---|---|---|
| 4,452,051 | A | 6/1984 | Berger et al. | |
| 5,341,870 | A | 8/1994 | Hughes et al. | |
| 6,793,010 | B1 * | 9/2004 | Manole | F28F 1/32 62/526 |

(Continued)

FOREIGN PATENT DOCUMENTS

| | | | |
|---|---|---|---|
| CN | 201992742 | U | 9/2011 |
| JP | 2005226878 | A | 8/2005 |
| TW | 201336398 | A | 9/2013 |

*Primary Examiner* — Henry T Crenshaw
*Assistant Examiner* — Kamran Tavakoldavani
(74) *Attorney, Agent, or Firm* — Muncy, Geissler, Olds & Lowe, P.C.

(57) ABSTRACT

A thermosiphon heat exchanger includes a chassis, an evaporation assembly and a condensation assembly. The chassis has an internal circulation chamber and an external circulation chamber separated from each other. The evaporation assembly is disposed in the internal circulation chamber. The condensation assembly is disposed in the external circulation chamber and horizontally positioned higher than the evaporation assembly, and the condensation assembly is coupled to the evaporation assembly by plural separated loops.

17 Claims, 6 Drawing Sheets

(56) References Cited

U.S. PATENT DOCUMENTS

| | | | |
|---|---|---|---|
| 9,303,882 | B2 | 4/2016 | Hancock |
| 9,791,221 | B1 | 10/2017 | Litch |
| 2005/0274120 | A1 | 12/2005 | Quisenberry et al. |
| 2008/0014854 | A1 | 1/2008 | Tigner |
| 2010/0041327 | A1 | 2/2010 | Desler |
| 2010/0326624 | A1 | 12/2010 | Hancock |
| 2012/0186787 | A1 | 7/2012 | Dinh |

* cited by examiner

THERMOSIPHON HEAT EXCHANGER

CROSS-REFERENCE TO RELATED APPLICATIONS

This application claims priority to China Patent Application No. 20201062179.0 filed Jun. 9, 2020, and is a Continuation-In-Part of pending U.S. patent application Ser. No. 16/881,847, filed on May 22, 2020 and entitled "HEAT-EXCHANGE APPARATUS", which is a Continuation of U.S. Pat. No. 10,697,709B2, issued Jun. 30, 2020 and entitled "HEAT-EXCHANGE APPARATUS", which claims priority of China Patent Application No. 201310536088.4, filed on Oct. 31, 2013. The entire disclosures of the above applications are all incorporated herein by reference.

BACKGROUND OF THE INVENTION

1. Technical Field

The technical field of this disclosure relates to thermosiphon heat exchangers, and more particularly to a thermosiphon heat exchanger with an asymmetrical performance on internal and external heat exchanges.

2. Description of Related Art

Heat exchangers are often used for the purpose of dissipating heat from a sub-device cabinet, and this disclosure is related to the thermosiphon heat exchanger. The thermosiphon heat exchanger is generally divided into an internal circulation side and an external circulation side by a partition panel, the internal circulation side is communicated with the cabinet interior space while the external circulation side is communicated with the external environment, and the internal circulation side and the external circulation side do not exchange air with each other. Both the internal circulation side and the external circulation side have separate heat exchangers, and the heat exchangers of both sides are communicated with each other by passing a pipeline through the partition panel. A working fluid is filled into the heat exchanger, the hot air inside the heat exchanger of the internal circulation side and the cabinet exchange heat to carry the heat away, and the heat flows through the vaporized working fluid in a direction towards the heat exchanger of the external circulation side through the pipeline. The gas-state working fluid is cooled and condensed by the heat exchanger of the external circulation side and the ambient heat exchange. The liquid-state working fluid in the heat exchanger of the external circulation side is returned to the heat exchanger of the internal circulation side through the pipeline to perform the next heat exchange cycle.

The conventional thermosiphon heat exchanger generally has symmetrical heat exchangers and fans on both internal and external circulation sides, so that the heat exchangeability of both internal and external circulation sides is the same. However, the heat exchange of the evaporation and the heat exchange of the condensation are not the same. In other words, the heat exchange efficiency of the inner side and that of the outer side are different according to the different temperatures of the inner and outer sides, and the components on one of the sides causes ineffective heat exchangeability, and thus wastes part of the manufacturing costs.

In view of the aforementioned drawbacks of the prior art, the discloser of the present disclosure, based on years of experience in the related industry, has conducted extensive research and experiments and finally provided a feasible solution to overcome the drawbacks of the prior art.

SUMMARY OF THE INVENTION

Therefore, it is a primary object of this disclosure to provide a thermosiphon heat exchanger with asymmetrical internal and external heat exchange structures.

To achieve the aforementioned and other objectives, the present disclosure discloses a thermosiphon heat exchanger comprising a chassis, an evaporator, a first condenser, a second condenser, a first loop, and a second loop. The chassis has an internal circulation chamber and an external circulation chamber which are separated from each other. The evaporator is disposed in the internal circulation chamber. The first condenser is disposed in the external circulation chamber and is horizontally positioned higher than the evaporator. The second condenser is disposed in the external circulation chamber and is horizontally positioned higher than the evaporator. The first loop communicates with the first condenser and the evaporator. The second loop communicates with the second condenser and the evaporator and is separated from the first loop.

The thermosiphon heat exchanger of this disclosure further comprises a fan for producing and passing airflow through the evaporator, the first condenser, or the second condenser. The first condenser and the second condenser have unequal heat exchange areas. The evaporator, the first condenser, or the second condenser has a plurality of fins.

The thermosiphon heat exchanger of this disclosure further comprises a refrigerant flowing in the first loop, the second loop, the evaporator, the first condenser, and the second condenser. The refrigerant flows and meets in the evaporator.

This disclosure further discloses a thermosiphon heat exchanger comprising a chassis, a condenser, a first evaporator, a second evaporator, a first loop, and a second loop. The chassis has an internal circulation chamber and an external circulation chamber formed therein and which are separated from each other. The condenser is disposed in the external circulation chamber. The first evaporator is disposed in the internal circulation chamber and is horizontally positioned lower than the condenser. The second evaporator is disposed in the internal circulation chamber and is horizontally positioned lower than the condenser. The first loop communicates with the first evaporator and the condenser. The second loop communicates with the second evaporator and the evaporator is separated from the first loop.

The thermosiphon heat exchanger of this disclosure further comprises a fan for forming and passing airflow through the condenser, the first evaporator, or the second evaporator. The first evaporator and the second evaporator have unequal heat exchange areas. The condenser, the first evaporator or the second evaporator has a plurality of fins.

The thermosiphon heat exchanger of this disclosure further comprises a refrigerant flowing in the first loop, the second loop, the condenser, the first evaporator and the second evaporator. The refrigerant flows and meets in the condenser.

This disclosure discloses a thermosiphon heat exchanger comprising a chassis, an evaporation assembly and a condensation assembly. The chassis has an internal circulation chamber and an external circulation chamber formed therein and separated from each other. The evaporation assembly is disposed in the internal circulation chamber, and the evaporation assembly is comprised of one or more evaporators. The condensation assembly is disposed in the external circulation chamber, is horizontally positioned higher than the evaporation assembly, and the condensation assembly is comprised of one or more condensers. The quantity of evaporators of the evaporation assembly is unequal to the quantity of condensers of the condensation assembly, or the heat exchange area of the evaporation assembly is unequal to the heat exchange area of the condensation assembly. The heat exchanger is a thermosiphon heat exchanger not coupled to the compressor, and the evaporation assembly and the condensation assembly are communicated with each other through a non-pressurized pipeline.

The thermosiphon heat exchanger of this disclosure further comprises a fan for forming and passing airflow through the evaporation assembly or the condensation assembly, and the evaporation assembly or the condensation assembly has a plurality of fins.

The thermosiphon heat exchanger of this disclosure further comprises a refrigerant flowing in the loops, the evaporation assembly, and the condensation assembly. The refrigerant flows and meets in the evaporation assembly or the condensation assembly.

In the thermosiphon heat exchanger of this disclosure, the internal and external circulations have asymmetrical heat exchangeabilities and provide an appropriately sufficient heat exchangeability to prevent a waste of manufacturing costs caused by excessive heat exchangeability.

DESCRIPTION OF THE PREFERRED EMBODIMENTS

The technical contents of this disclosure will become apparent with the detailed description of preferred embodiments accompanied with the illustration of related drawings as follows. It is intended that the embodiments and drawings disclosed herein are to be considered illustrative rather than restrictive.

Figure 1:
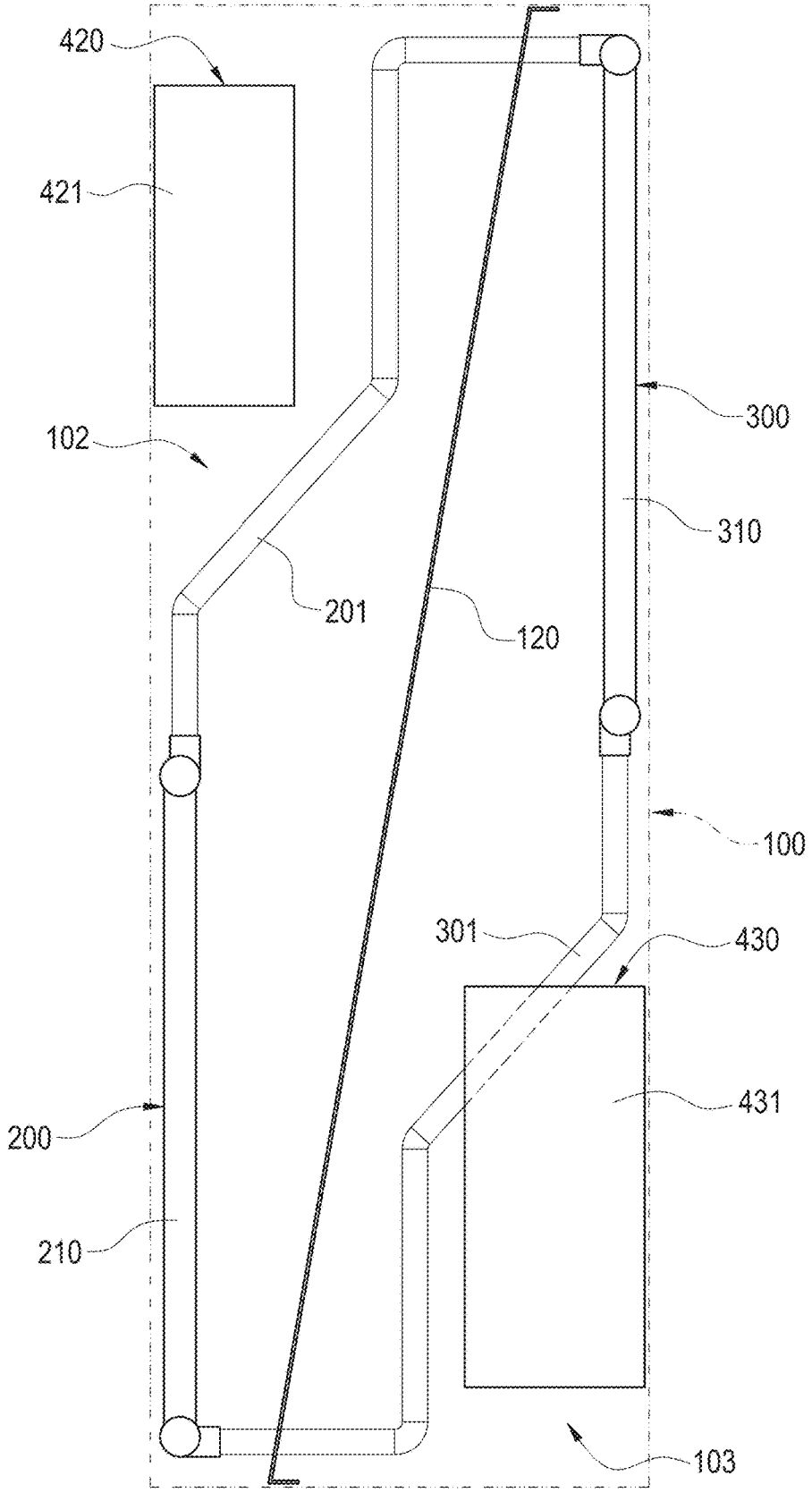
FIG. 1 is a schematic view of a phase-change heat transfer device in accordance with a first embodiment of the present disclosure.
Figure 2:
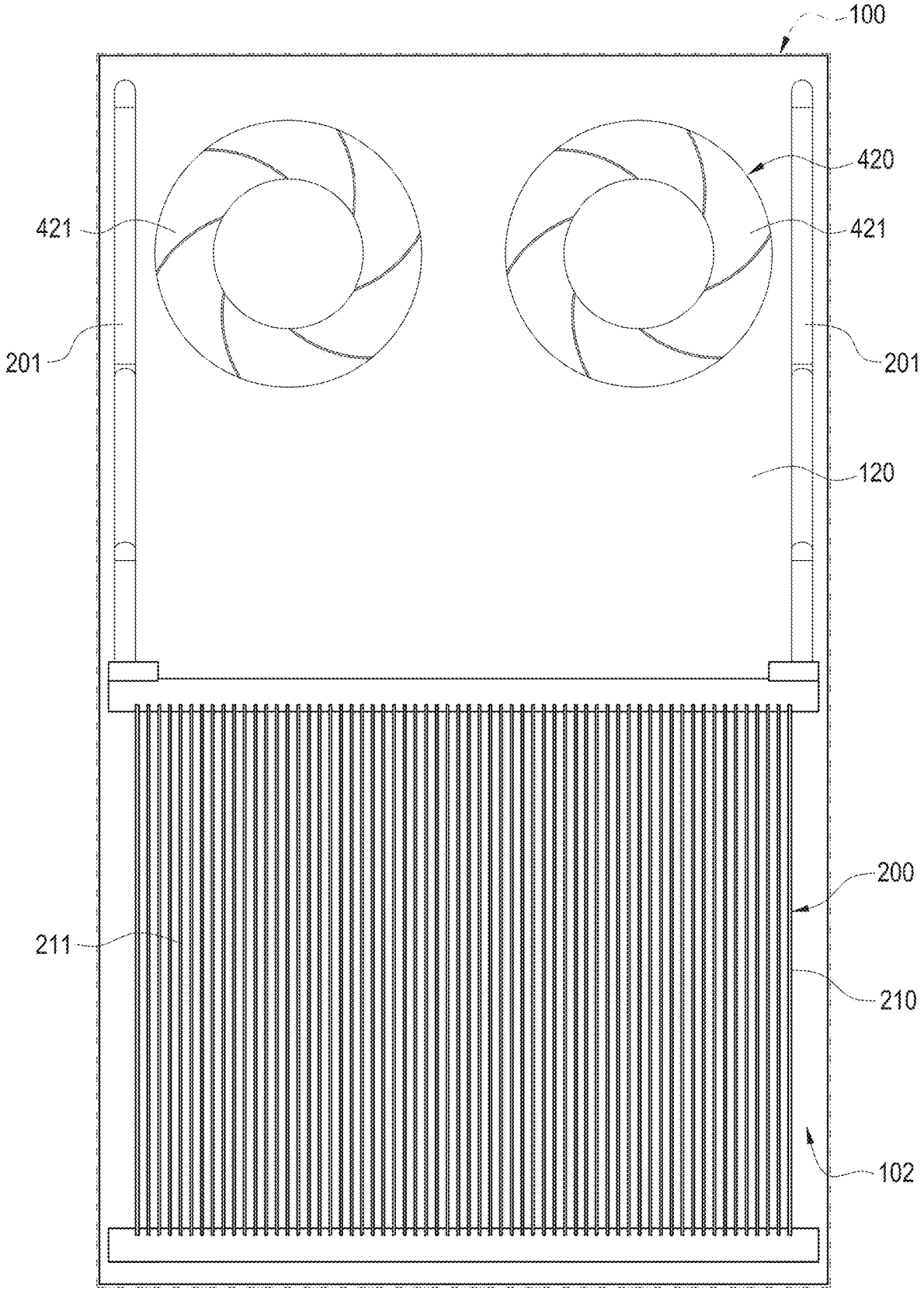
FIG. 2 is a schematic view of an internal circulation chamber of a phase-change heat transfer device in accordance with the first embodiment of the present disclosure.
Figure 3:
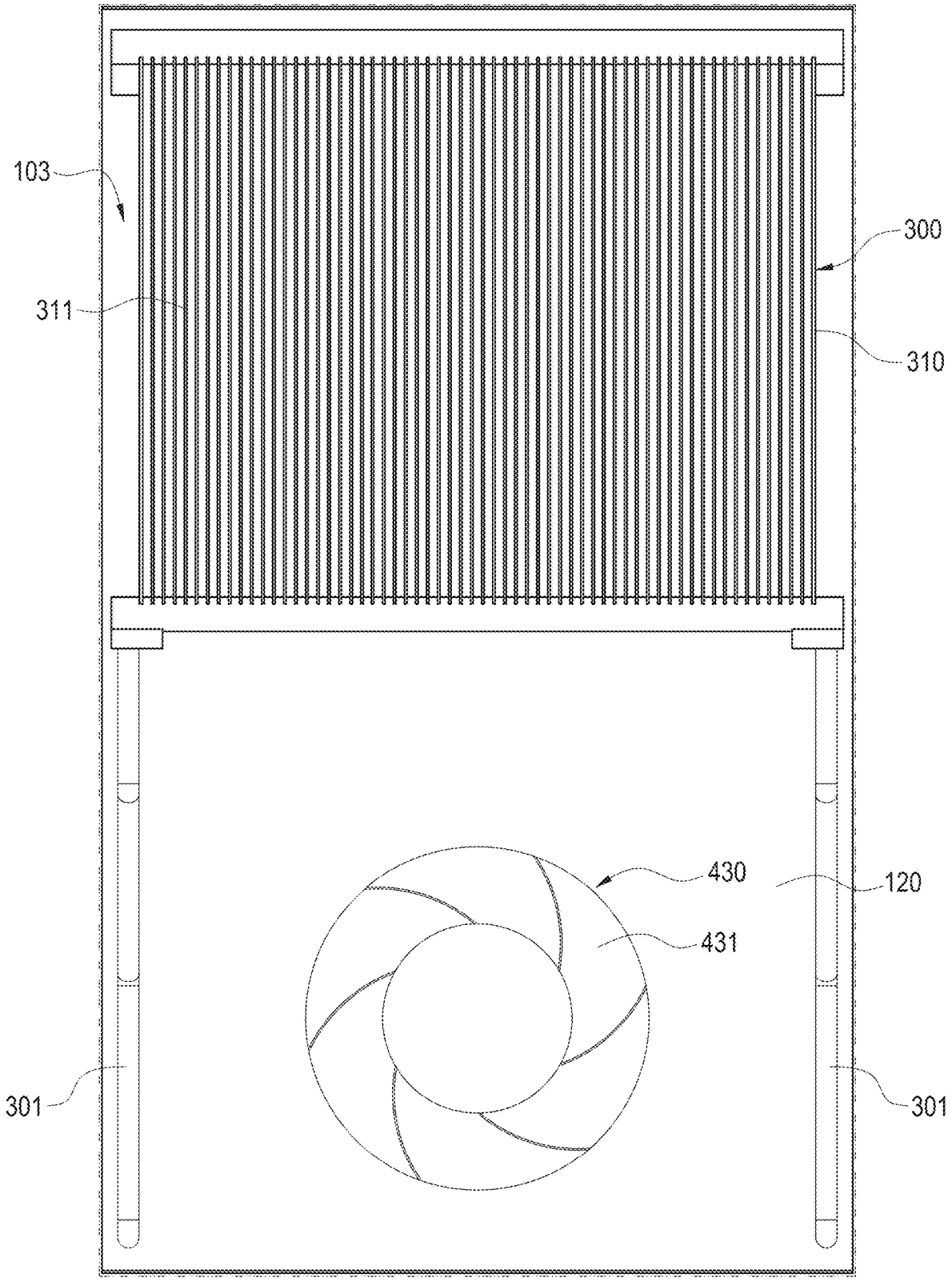
FIG. 3 is a schematic view of an external circulation chamber of a phase-change heat transfer device in accordance with the first embodiment of the present disclosure.

With reference to FIGS. 1 to 3 for a thermosiphon heat exchanger with asymmetrical internal and external heat exchange efficiencies in accordance with the first embodiment of this disclosure, the thermosiphon heat exchanger comprises a chassis 100, an evaporation assembly 200, a condensation assembly 300, a first circulation fan module 420, and a second circulation fan module 430.

The chassis 100 is separated from an internal circulation chamber 102 and an external circulation chamber 103 by a partition panel 120. The evaporation assembly 200 is disposed in the internal circulation chamber 102. The condensation assembly 300 is disposed in the external circulation chamber 103 and horizontally positioned higher than the evaporation assembly 200, and the condensation assembly 300 and the evaporation assembly 200 are coupled and communicated with each other by a plurality of separated loops. It is noteworthy that the thermosiphon heat exchanger of this disclosure is not coupled to the compressor, so that the loops are non-pressurized pipelines. In this embodiment, a pair of loops are provided, and each loop comprises a steam pipe 201 and a return pipe 301. Specifically, the evaporation assembly 200 has an evaporator 210, and the condensation assembly 300 has a condenser 310. The evaporator 210 and the condenser 310 have a plurality of fins (211/311). The evaporation assembly 200 is horizontally positioned lower than the condensation assembly 300. The steam pipe 201 has an end coupled to the top of the evaporator 210 and the other end coupled to the top of the condenser 310. The return pipe 301 has an end coupled to the bottom of the evaporator 210 and the other end coupled to the bottom of the condenser 310. The evaporator 210 contains a working fluid which is a refrigerant in a preferred embodiment. At the beginning, the working fluid flows and meets in the evaporator 210. After the working fluid is vaporized in the evaporator 210, the gas-state working fluid flows into the condenser 310 through the steam pipe 201. After the gas-state working fluid is cooled and liquefied, the liquid-state working fluid returns into the evaporator 210. The first circulation fan module 420 is configured to be responsive to the evaporator 210 and drives airflow to flow through the evaporator 210 and the steam pipe 201.

The second circulation fan module 430 is configured to be corresponsive to the condensation assembly 300 and drives the airflow to pass through the condensation assembly 300 and the return pipe 301, wherein the volumetric flow rates of air driven by the first circulation fan module 420 and the second circulation fan module 430 are unequal. In a preferred embodiment, the volumetric flow rate of the air driven by the first circulation fan module 420 is greater than the volumetric flow rate of the air driven by the second circulation fan module 430. The second circulation fan module 430 has at least one fan 431, and the first circulation fan module 420 has a plurality of fans 421 with a quantity greater than that of the second circulation fan module 430. Therefore, the volumetric flow rate of the air driven by the first circulation fan module 420 is greater than the volumetric flow rate of the air driven by the second circulation fan module 430. However, this disclosure is not limited to this arrangement only. For example, the first circulation fan module 420 and the second circulation fan module 430 can also have the same quantity of fans 421/431, and the output power of the first circulation fan module 420 is greater than the output power of the second circulation fan module 430.

When the ambient temperature is low, the condensation assembly 300 can disperse the working fluid to dissipate the heat from the evaporation assembly 200 by natural convection, so that the second circulation fan module 430 as shown in FIGS. 1 and 3 is no longer required.

Figure 4:
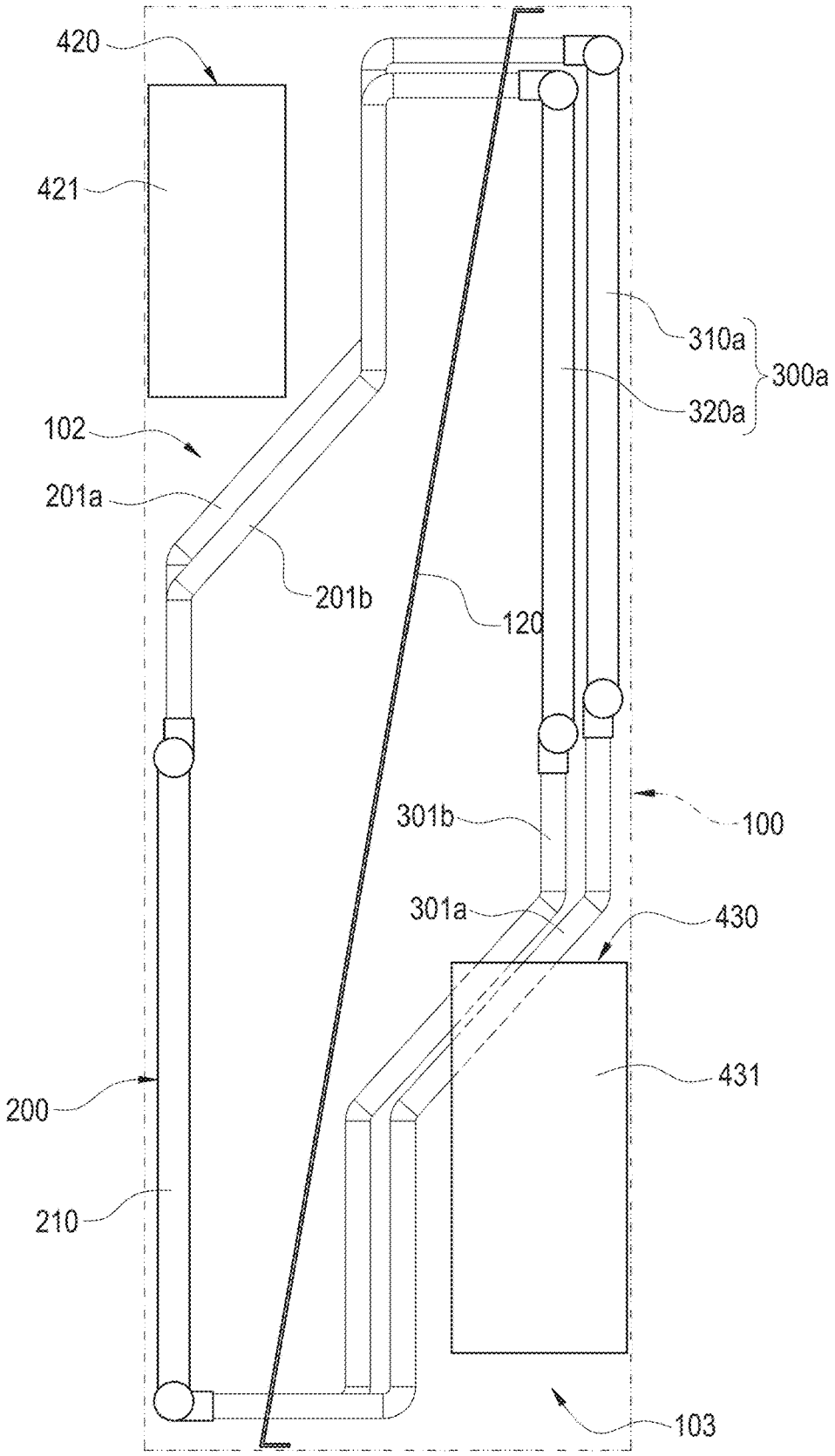
FIG. 4 is a schematic view of a phase-change heat transfer device in accordance with a second embodiment of the present disclosure.

With reference to FIG. 4 for a thermosiphon heat exchanger in accordance with the second embodiment of this disclosure, the thermosiphon heat exchanger comprises a chassis 100, an evaporation assembly 200, and a condensation assembly 300*a*, wherein the chassis 100 is the same as that of the first embodiment, and thus its description will not be repeated.

In addition, the evaporation assembly 200 is also horizontally positioned lower than the condensation assembly 300*a*.

The evaporation assembly 200 and the condensation assembly 300*a* are coupled with each other by a first loop and a second loop which are separated from each other. The thermosiphon heat exchanger of this disclosure is not coupled to the compressor, so that the first loop and the second loop are non-pressurized pipelines, wherein the first loop comprises a steam pipe 201*a* and a return pipe 301*a*, and the second loop comprises a steam pipe 202*a* and a return pipe 302*a*. Each steam pipe 201*a*/202*a* has an end coupled to the top of the evaporation assembly 200 and the other end coupled to the top of the condensation assembly 300*a*. Each return pipe 301*a*/302*a* has an end coupled to the bottom of the evaporation assembly 200 and the other end coupled to the bottom of the condensation assembly 300*a*.

Figure 5:
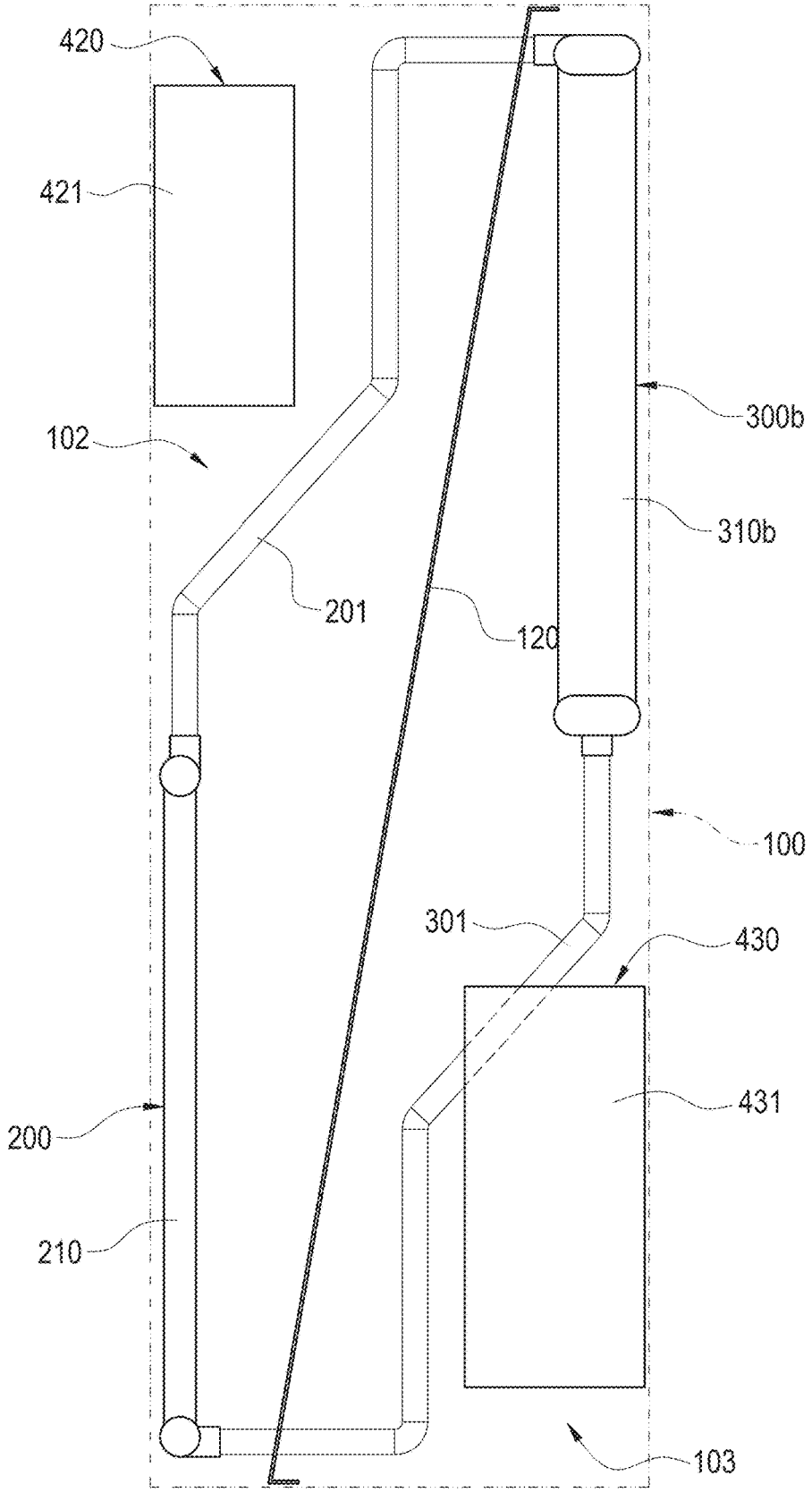
FIG. 5 is a schematic view of a phase-change heat transfer device in accordance with another implementation mode of the second embodiment of the present disclosure.

However, the evaporation assembly 200 and the condensation assembly 300*a* of this embodiment are different from those of the previous embodiment, and their difference resides on that the heat exchange area of the evaporation assembly 200 and the heat exchange area of the condensation assembly 300*a* being different in this embodiment. Specifically, the evaporation assembly 200 has at least one evaporator 210, and the condensation assembly 300*a* has a first condenser 310*a* and a second condenser 320*a*. The evaporator 210, the first condenser 310*a* and the second condenser 320*a* (same as the previous embodiment) have a plurality of fins. Each steam pipe 201*a*/202*a* has an end coupled to the top of evaporator 210 and the other end coupled to the top of the first condenser 310*a* and the top of the second condenser 320*a*. Each return pipe 301*a*/302*a* has an end coupled to the bottom of the evaporator 210 and the other end coupled to the bottom of the first condenser 310*a* and the bottom of the second condenser 320*a*. Therefore, the heat exchange area of the evaporation assembly 200 and the heat exchange area of the condensation assembly 300*a* are unequal. However, this disclosure is not limited to this arrangement only. For example, in another embodiment as shown in FIG. 5, the evaporation assembly 200 has an evaporator 210, and the condensation assembly 300*a* has a condenser 330*a*, and the model of the condenser 330*a* is different from the model of the evaporator 210, and the condensation assembly 300*a* and the evaporation assembly 200 are coupled and communicated with each other by at least one loop. Therefore, the heat exchange area of the evaporation assembly 200 is unequal to the heat exchange area of the condensation assembly 300*a*.

The thermosiphon heat exchanger of this embodiment can be selectively the same as that of the first embodiment and further comprises a first circulation fan module 420 and a second circulation fan module 430. The first circulation fan module 420 is configured to be corresponsive to the evaporation assembly 200 and drives airflow to pass through the evaporation assembly 200 and the steam pipe 201*a*/202*a*, and the second circulation fan module 430 is configured to be corresponsive to the condensation assembly 300*a* and drives airflow to flow through the condensation assembly 300*a* and the return pipe 301*a*/302*a*. In addition, the heat exchange area of the evaporation assembly 200 where the first circulation fan module 420 drives airflow to flow through, and the heat exchange area wherein the second circulation fan module 430 drives airflow to flow through the condensation assembly 300*a* are unequal.

Figure 6:
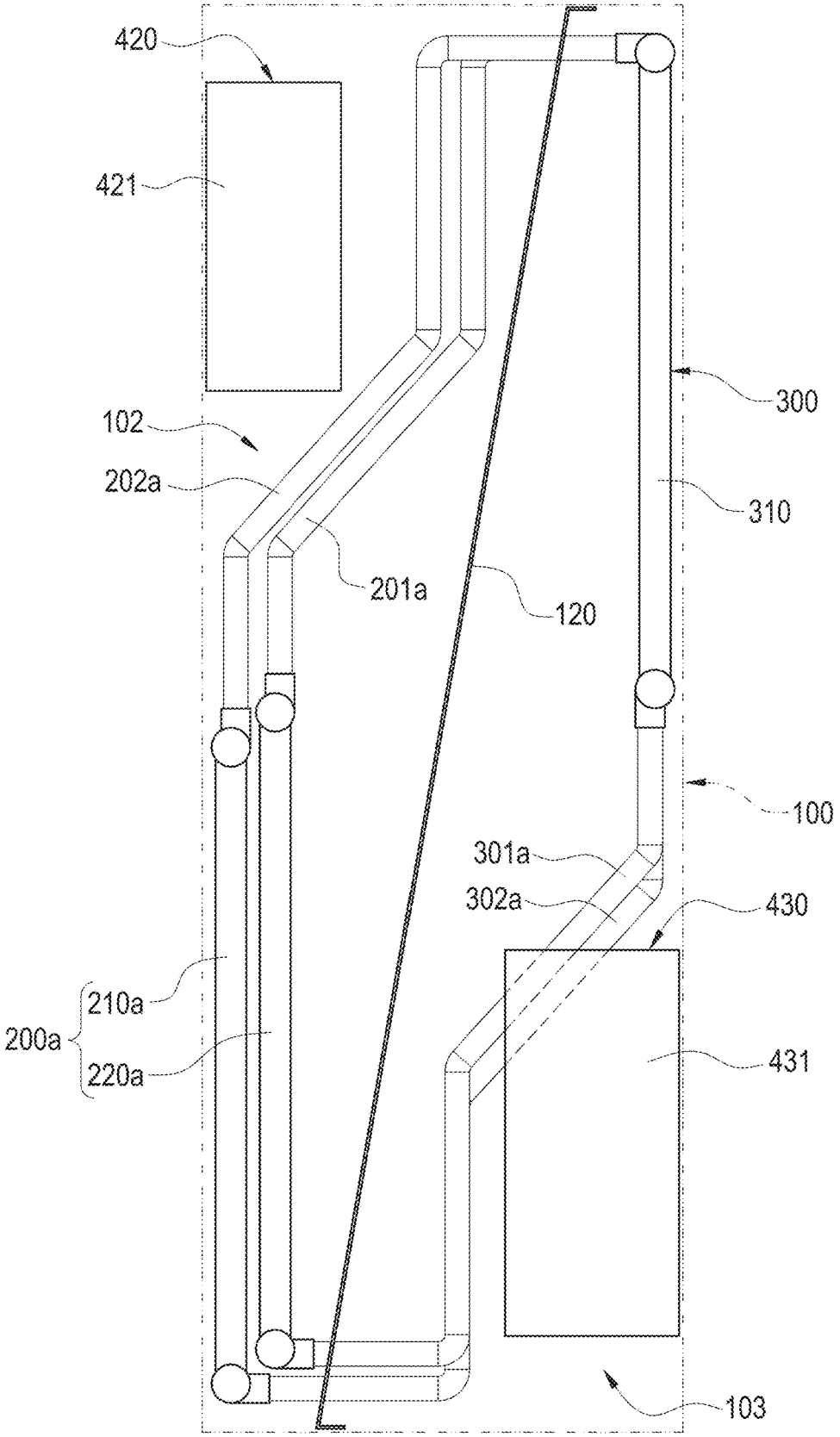
FIG. 6 is a schematic view of a phase-change heat transfer device in accordance with a third embodiment of the present disclosure.

With reference to FIG. 6 for a thermosiphon heat exchanger in accordance with the third embodiment of this disclosure, the thermosiphon heat exchanger comprises a chassis 100, an evaporation assembly 200*a*, a condensation assembly 300, a first loop, and a second loop, wherein the chassis 100 of this embodiment is the same as that of the previous embodiments, and thus its description thus will not be repeated.

The condensation assembly 300 has a condenser 310 disposed in the external circulation chamber 103.

The evaporation assembly 200*a* has a first evaporator 210*a* and a second evaporator 220*a*. The first evaporator 210*a* is disposed in the internal circulation chamber 102 and is horizontally positioned lower than the condenser 310. The second evaporator 220*a* is disposed in the internal circulation chamber 102 and is horizontally positioned lower than the condenser 310. Same as the previous embodiment, the condenser 310, the first evaporator 210*a*, and the second evaporator 210*a* of this embodiment also have a plurality of fins.

The first loop and the second loop are separated from each other. The thermosiphon heat exchanger of this disclosure is not coupled to the compressor, so that the first loop and the second loop are non-pressurized pipelines. The first loop comprises a steam pipe 201*a* and a return pipe 301*a*, and the second loop also comprises a steam pipe 202*a* and a return pipe 302*a*. Each steam pipe 201*a*/202*a* has an end coupled to the top of the evaporation assembly 200*a* and the other end coupled to the top of the condensation assembly 300. Specifically, each steam pipe 201*a*/202*a* has an end coupled to the top of the first evaporator 210*a* and the top of the second evaporator 220*a* and the other end coupled to the top of the condenser 310. Each return pipe 301*a*/302*a* has an end coupled to the bottom of the evaporation assembly 200*a* and the other end coupled to the bottom of the condensation assembly 300. Specifically, each return pipe 301*a*/302*a* has an end coupled to the bottom of the first evaporator 210*a* and the bottom of the second evaporator 220*a* and the other end coupled to the bottom of the condenser 310. Therefore, the heat exchange area of the evaporation assembly 200*a* and the heat exchange area of the condensation assembly 300 are unequal.

The thermosiphon heat exchanger of this embodiment can be selectively the same as that of the first embodiment and further comprises a first circulation fan module 420 and a second circulation fan module 430. The first circulation fan module 420 is configured to be corresponsive to evaporation assembly 200 and drives airflow to pass through the evaporation assembly 200 and the steam pipe 201*a*/202*a*. The second circulation fan module 430 is configured to be corresponsive to the condensation assembly 300*a* and drives airflow to flow through the condensation assembly 300*a* and the return pipe 301*a*/302*a*.

The thermosiphon heat exchanger of the aforementioned embodiment of this disclosure provides asymmetrical heat exchangeabilities of the internal and external circulations, so that the internal and external circulations have asymmetrical heat exchangeabilities and provide an appropriately sufficient heat exchangeability to prevent a waste of manufacturing costs caused by excessive heat exchangeability. In this disclosure, the same overall heat dissipation effect can be achieved by a lower manufacturing cost.

While this disclosure has been described by means of specific embodiments, numerous modifications and variations could be made thereto by those skilled in the art without departing from the scope and spirit of this disclosure set forth in the claims.

What is claimed is:

1. A thermosiphon heat exchanger, comprising:

a chassis, having an internal circulation chamber and an external circulation chamber formed therein and separated from each other;

an evaporator, disposed in the internal circulation chamber;

a first condenser, disposed in the external circulation chamber and horizontally positioned higher than the evaporator;

a second condenser, disposed in the external circulation chamber and horizontally positioned higher than the evaporator;

a first loop, communicating with the first condenser and the evaporator; and a second loop, communicating with the second condenser and the evaporator, and separated from the first loop;

wherein, the first loop and the second loop are non-pressurized pipelines.

2. The thermosiphon heat exchanger as claimed in claim 1, further comprising a fan for producing and passing airflow through the evaporator, the first condenser, or the second condenser.

3. The thermosiphon heat exchanger as claimed in claim 1, wherein the first condenser and the second condenser have unequal heat exchange areas.

4. The thermosiphon heat exchanger as claimed in claim 1, wherein the evaporator, the first condenser or the second condenser has a plurality of fins.

5. The thermosiphon heat exchanger as claimed in claim 1, further comprising a refrigerant flowing in the first loop, the second loop, the evaporator, the first condenser, and the second condenser.

6. The thermosiphon heat exchanger as claimed in claim 5, wherein the refrigerant flows and meets in the evaporator.

7. A thermosiphon heat exchanger, comprising:

a chassis, having an internal circulation chamber and an external circulation chamber formed therein and separated from each other;

a condenser, disposed in the external circulation chamber;

a first evaporator, disposed in the internal circulation chamber and horizontally positioned lower than the condenser;

a second evaporator, disposed in the internal circulation chamber and horizontally positioned lower than the condenser;

a first loop, communicating with the first evaporator and the condenser; and a second loop communicating with the second evaporator and the condenser, and separated from the first loop;

wherein, the first loop and the second loop are non-pressurized pipelines.

8. The thermosiphon heat exchanger as claimed in claim 7, further comprising a fan for forming and passing airflow through the condenser, the first evaporator, or the second evaporator.

9. The thermosiphon heat exchanger as claimed in claim 7, wherein the first evaporator and the second evaporator have unequal heat exchange areas.

10. The thermosiphon heat exchanger as claimed in claim 7, wherein the condenser, the first evaporator, or the second evaporator has a plurality of fins.

11. The thermosiphon heat exchanger as claimed in claim 7, further comprising a refrigerant flowing in the first loop, the second loop, the condenser, the first evaporator and the second evaporator.

12. The thermosiphon heat exchanger as claimed in claim 11, wherein the refrigerant flows and meets in the condenser.

13. A thermosiphon heat exchanger, comprising:

a chassis, having an internal circulation chamber and an external circulation chamber formed therein and separated from each other;

an evaporation assembly, disposed in the internal circulation chamber, and comprised of one or more evaporators; and a condensation assembly, disposed in the external circulation chamber, and horizontally positioned higher than the evaporation assembly, and the condensation assembly being comprised of one or more condensers;

wherein, the quantity of evaporators of the evaporation assembly is unequal to the quantity of condenser of the condensation assembly, or the heat exchange area of the evaporation assembly is unequal to the heat exchange area of the condensation assembly;

wherein the evaporation assembly and the condensation assembly communicate with each other by a non-pressurized pipeline.

14. The thermosiphon heat exchanger as claimed in claim 13, further comprising a fan for forming and passing airflow through the evaporation assembly or the condensation assembly.

15. The thermosiphon heat exchanger as claimed in claim 13, wherein the evaporation assembly or the condensation assembly has a plurality of fins.

16. The thermosiphon heat exchanger as claimed in claim 13, further comprising a refrigerant flowing in the loops, the evaporation assembly, and the condensation assembly.

17. The thermosiphon heat exchanger as claimed in claim 16, wherein the refrigerant flows and meets in the evaporation assembly or the condensation assembly.

* * * * *